US007228647B2

(12) United States Patent
Hong

(10) Patent No.: US 7,228,647 B2
(45) Date of Patent: Jun. 12, 2007

(54) DRYING MACHINE AND DRYING MACHINE WITH WASHING FUNCTION AND METHOD OF CONTROLLING THE SAME

(75) Inventor: Sang Wook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/032,110

(22) Filed: Jan. 11, 2005

(65) Prior Publication Data

US 2006/0096114 A1 May 11, 2006

(30) Foreign Application Priority Data

Nov. 6, 2004 (KR) ..... 10-2004-0090147

(51) Int. Cl.
*F26B 11/02* (2006.01)

(52) U.S. Cl. ..... 34/596; 34/604; 68/18 C; 68/19.2

(58) Field of Classification Search ..... 34/77, 34/596, 604, 606, 392, 468, 476; 68/18 C, 68/19.2

See application file for complete search history.

(56) References Cited

U.S. PATENT DOCUMENTS 2,752,694 A * 7/1956 McCormick ..... 34/60
4,103,433 A * 8/1978 Taylor ..... 34/86
4,137,645 A * 2/1979 Bullock ..... 34/467
4,154,003 A * 5/1979 Muller ..... 34/469
4,519,145 A * 5/1985 Mandel ..... 34/389
5,146,693 A * 9/1992 Dottor et al. ..... 34/77
6,748,772 B2 * 6/2004 Lee et al. ..... 68/18 C
7,036,243 B2 * 5/2006 Doh et al. ..... 34/595
2005/0223585 A1 * 10/2005 Jeon et al. ..... 34/82

FOREIGN PATENT DOCUMENTS

KR 2003-17756 3/2003

OTHER PUBLICATIONS

U.S. Appl. No. 10/957,601 to Jeon et al., which was filed on Oct. 5, 2004.
English language abstract of KOREAN 2003-17756.

* cited by examiner

*Primary Examiner*—S. Gravini
(74) *Attorney, Agent, or Firm*—Greenblum & Bernstein, P.L.C.

(57) ABSTRACT

Disclosed herein is a drying machine or a drying machine with washing function. The drying machine or the drying machine with washing function comprises a heater for heating air introduced into an inlet channel of a drum, an outlet channel for allowing air in the drum to be discharged out of the drying machine or the drying machine with washing function therethrough, and a circulating channel connected between the outlet channel of the drum and the heater. When the exhaust resistance of air at the outlet channel is large, some of air, passing through the outlet channel, is guided to the heater through the circulating channel. Consequently, the drying machine or the drying machine with washing function according to the present invention has an effect in that air flow rate sufficient to dry the laundry is obtained and time necessary to dry the laundry is reduced.

11 Claims, 9 Drawing Sheets

DRYING MACHINE AND DRYING MACHINE WITH WASHING FUNCTION AND METHOD OF CONTROLLING THE SAME

BACKGROUND OF THE INVENTION

1. Field of the Invention

The present invention relates to a drying machine or a drying machine with washing function that is capable of drying the laundry either in an exhausting fashion or in a condensing fashion. The present invention also relates to a method of controlling the same.

2. Description of the Related Art

Generally, a laundry drying machine is a machine that supplies dry hot wind, heated by a heater mounted in the laundry drying machine, into a laundry-receiving space, where clothes (hereinafter, referred to as "laundry") are put, to dry the laundry. The laundry drying machine is classified into a drying machine that only dries the laundry and a drying machine with washing function that not only washes but also dries the laundry.

Also, the laundry drying machine is classified into an exhausting-type drying machine and a condensing-type drying machine.

In the exhausting-type drying machine, low-temperature air introduced through an open-type inlet duct is heated by a heater to obtain high-temperature and low-humidity air, and the high-temperature and low-humidity air is introduced into a drum. In the drum, heat exchange occurs between the high-temperature and low-humidity air introduced into the drum and the laundry put in the drum. As a result, the air is changed into middle-temperature and high-humidity air. The middle-temperature and high-humidity air is discharged out of the drying machine through an outlet duct.

In the exhausting-type drying machine as described above, the outlet duct is connected to an external duct, which is long and extends to the outside of a house where the drying machine is installed. If the external duct is disposed with high exhaust resistance, or the exhaust resistance is increased as different external ducts are connected to drying machines installed in houses, however, air flow rate is abruptly decreased, and therefore, drying time is increased. Also, high-temperature and low-humidity air is discharged out of the drying machine at the end of the drying operation with the result that energy efficiency of the exhausting-type drying machine is decreased.

In the condensing-type drying machine, high-temperature and low-humidity air heated by the heater is supplied into the drum, where heat exchange occurs between the high-temperature and low-humidity air and the laundry put in the drum. As a result, the air is changed into middle-temperature and high-humidity air. The middle-temperature and high-humidity air passes through a condenser, where heat exchange occurs between the middle-temperature and high-humidity air and the condenser. As a result, the air is changed into low-temperature and low-humidity air. The low-temperature and low-humidity air is heated again by the heater, and is then supplied into the drum. The air supplied into the drum is changed into middle-temperature and high-humidity air as described above. In this way, the air is repeatedly circulated to dry the laundry.

In the condensing-type drying machine, however, the size of a circulating channel is restricted when the circulating channel is formed. Also, the flow resistance is relatively large, and therefore, the air flow rate is decreased and the drying time is increased as compared to the exhausting-type drying machine.

SUMMARY OF THE INVENTION

Therefore, the present invention has been made in view of the above problems, and it is an object of the present invention to provide a drying machine or a drying machine with washing function that is capable of obtaining air flow rate sufficient to dry the laundry and reducing time necessary to dry the laundry.

It is another object of the present invention to provide a method of controlling a drying machine or a drying machine with washing function that is capable of reducing power consumption of a heater and reducing total time necessary to dry the laundry.

In accordance with one aspect of the present invention, the above and other objects can be accomplished by the provision of a drying machine comprising: a drum disposed in a cabinet for receiving laundry; an inlet channel for allowing air to be introduced into the drum therethrough; a heater for heating air introduced into the inlet channel; an outlet channel for allowing air in the drum to be discharged out of the cabinet therethrough; and a circulating channel connected between the outlet channel and the heater.

Preferably, the drying machine further comprises: a condenser for condensing air passing through the circulating channel.

Preferably, the condenser comprises: first channel parts for allowing the air introduced into the circulating channel to flow therethrough; and second channel parts for allowing external air, necessary to take heat away from the air passing through the first channel parts, to flow therethrough.

Preferably, the condenser comprises: a condensing duct for allowing air introduced into the circulating channel to flow therethrough; and a cooling water supplying unit for supplying cooling water to the condensing duct to condense air passing through the condensing duct.

Preferably, the drying machine further comprises: a blowing fan disposed in the outlet channel between a drum-side outlet part for allowing air in the drum to flow to the outlet channel therethrough and one end of the circulating channel communicating with the outlet channel, whereby air is distributed to the outlet channel and the circulating channel based on the exhaust resistance of air at the rear of the outlet channel.

Preferably, the drying machine further comprises: an air flow rate control unit disposed in the outlet channel for controlling the flow rate of air passing through the outlet channel or the circulating channel.

Preferably, the air flow rate control unit comprises: an air flow rate control valve disposed in the outlet channel between a rear end of the outlet channel and one end of the circulating channel communicating with the outlet channel for controlling the flow rate of air discharged through the outlet channel.

In accordance with another aspect of the present invention, there is provided a drying machine with washing function, comprising: a tub mounted in a cabinet for receiving wash water necessary to wash or rinse laundry; a drum rotatably disposed inside the tub for receiving the laundry, the drum being provided with through-holes for allowing wash water or air to flow into or flow out of the tub therethrough; an inlet channel for introducing air into the drum; a heater for heating air introduced into the inlet channel; an outlet channel for discharging air, used to dry the laundry in the drum, out of the cabinet; and a circulating channel connected between the outlet channel and the heater.

Preferably, the drying machine with washing function further comprises: a condenser for condensing air passing through the circulating channel.

In accordance with yet another aspect of the present invention, there is provided a method of controlling a drying machine or a drying machine with washing function, the method comprising: a discharging/circulating step of controlling an air flow rate control unit to be operated in a dual mode such that some of the air having flowed out of a drum is condensed by a condenser and heated by the heater, and is then introduced into the drum, and the rest of the air is discharged out of the drying machine or the drying machine with washing function; and a circulating step of controlling the air flow rate control unit to be operated in a circulation mode such that all of the air having flowed out of the drum is condensed by the condenser and heated by the heater, and is then introduced into the drum.

Preferably, the circulation mode is selected when the temperature of the air flowing out of the drum is above a predetermined level.

Preferably, the circulation mode is selected after the discharging/circulating step has been performed for a predetermined period of time.

The drying machine or the drying machine with washing function according to the present invention has the following effects.

The drying machine or the drying machine with washing function according to the present invention comprises: a heater for heating air introduced into an inlet channel of a drum; an outlet channel for allowing air in the drum to be discharged out of the drying machine or the drying machine with washing function therethrough; and a circulating channel connected between the outlet channel of the drum and the heater. When the exhaust resistance of air at the outlet channel is large, some of the air, passing through the outlet channel, is guided to the heater through the circulating channel. Consequently, the drying machine or the drying machine with washing function according to the present invention has an effect in that air flow rate sufficient to dry the laundry is obtained and time necessary to dry the laundry is reduced.

The drying machine or the drying machine with washing function according to the present invention further comprises: a condenser for condensing air passing through the circulating channel. Consequently, the drying machine or the drying machine with washing function according to the present invention has an effect in that the laundry can be dried either in an exhausting fashion or in a condensing fashion.

Also, the method of controlling the drying machine or the drying machine with washing function according to the present invention has the following effect.

At the last stage of the drying operation or when the temperature of the air flowing out of the drum is above a predetermined level, all of the air having flowed out of the drum passes through the condenser and the heater, and is then introduced again into the drum such that the laundry can be repeatedly dried. At this time, the temperature of the air is relatively high while the humidity of the air is relatively low, as compared to the air introduced into the drum at the first stage of the drying operation. Consequently, the method of controlling the drying machine or the drying machine with washing function according to the present invention has an effect in that power consumption of the heater is reduced and total time necessary to dry the laundry is reduced.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
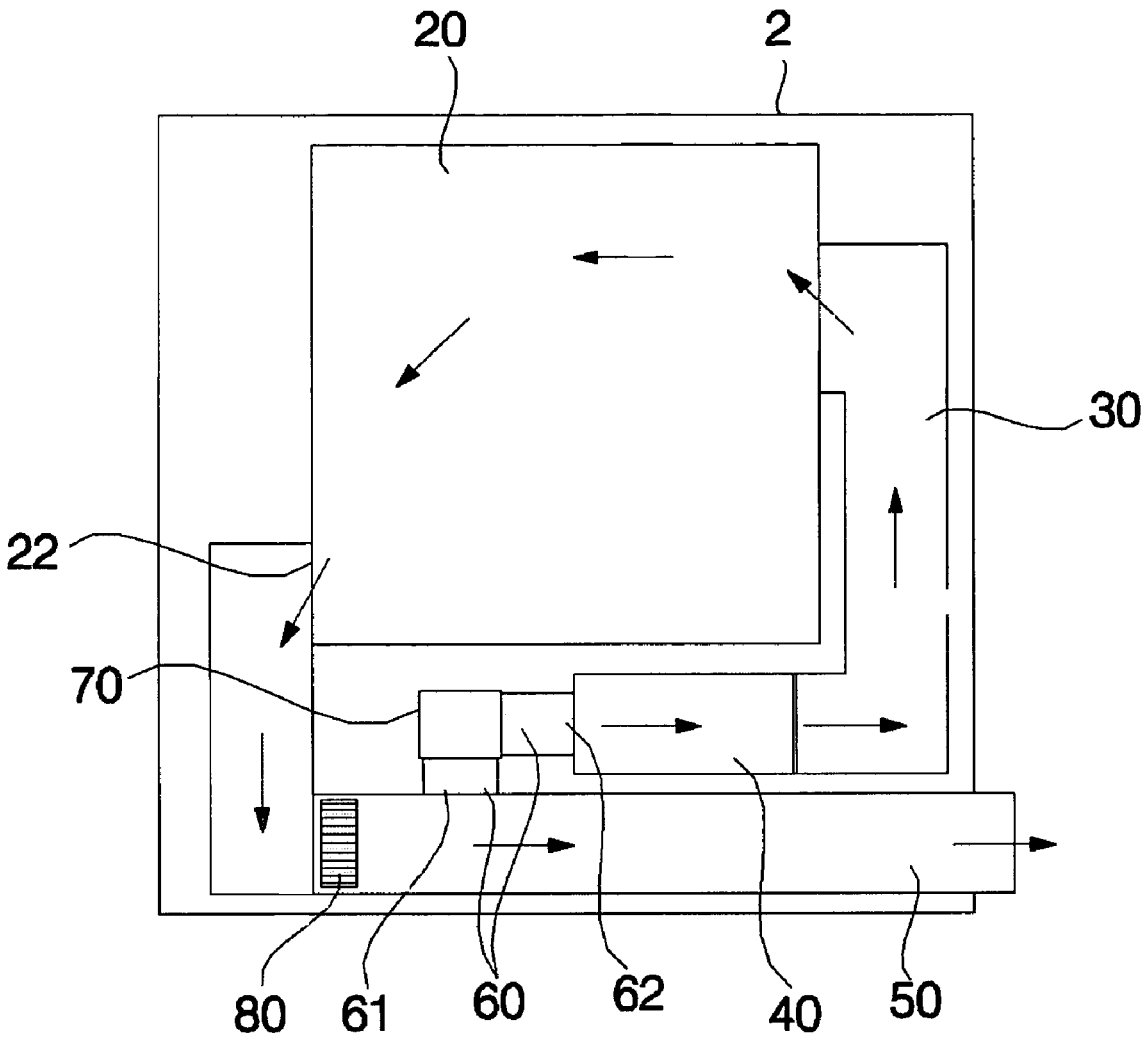
FIG. 1 is a schematic view illustrating air flow in a drying machine according to a preferred embodiment of the present invention.

FIG. 1 is a schematic view illustrating air flow in a drying machine according to a preferred embodiment of the present invention.

As shown in FIG. 1, the drying machine comprises: a cabinet 2; a drum 20 disposed in the cabinet 2 for receiving the laundry; an inlet channel 30 for allowing air to be introduced into the drum 20 therethrough; a heater 40 for heating air introduced into the inlet channel 30; an outlet channel 50 for allowing air in the drum 20 to be discharged out of the cabinet 2 therethrough; and a circulating channel 60 connected between the outlet channel 50 and the heater 40.

The circulating channel 60 has one end 61 communicating with a predetermined region of the circumferential part of the outlet channel 50 adjacent to the front end of the outlet channel 50 and the other end 62 communicating with the front end of the heater 40.

The drying machine further comprises: a blowing fan 80 disposed in the outlet channel 50 between a drum-side outlet part 22 for allowing air in the drum 20 to flow to the outlet channel 50 therethrough and the end 61 of the circulating channel 60, whereby air is distributed to the outlet channel 50 and the circulating channel 60 based on the exhaust resistance of air at the rear of the outlet channel 50.

The drying machine further comprises: a condenser 70 for condensing air passing through the circulating channel 60.

Figure 2:
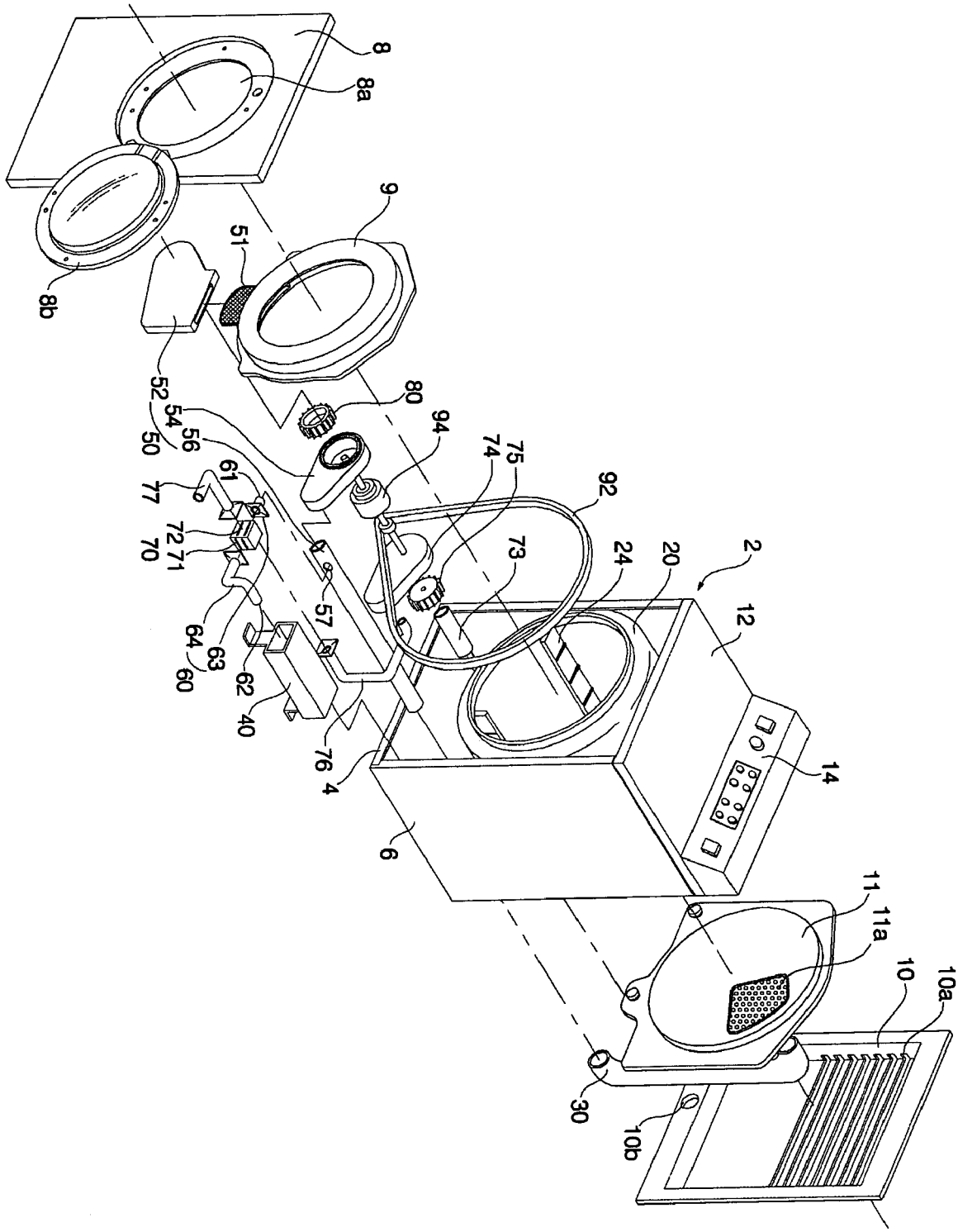
FIG. 2 is an exploded perspective view of the drying machine shown in FIG. 1.
Figure 3:
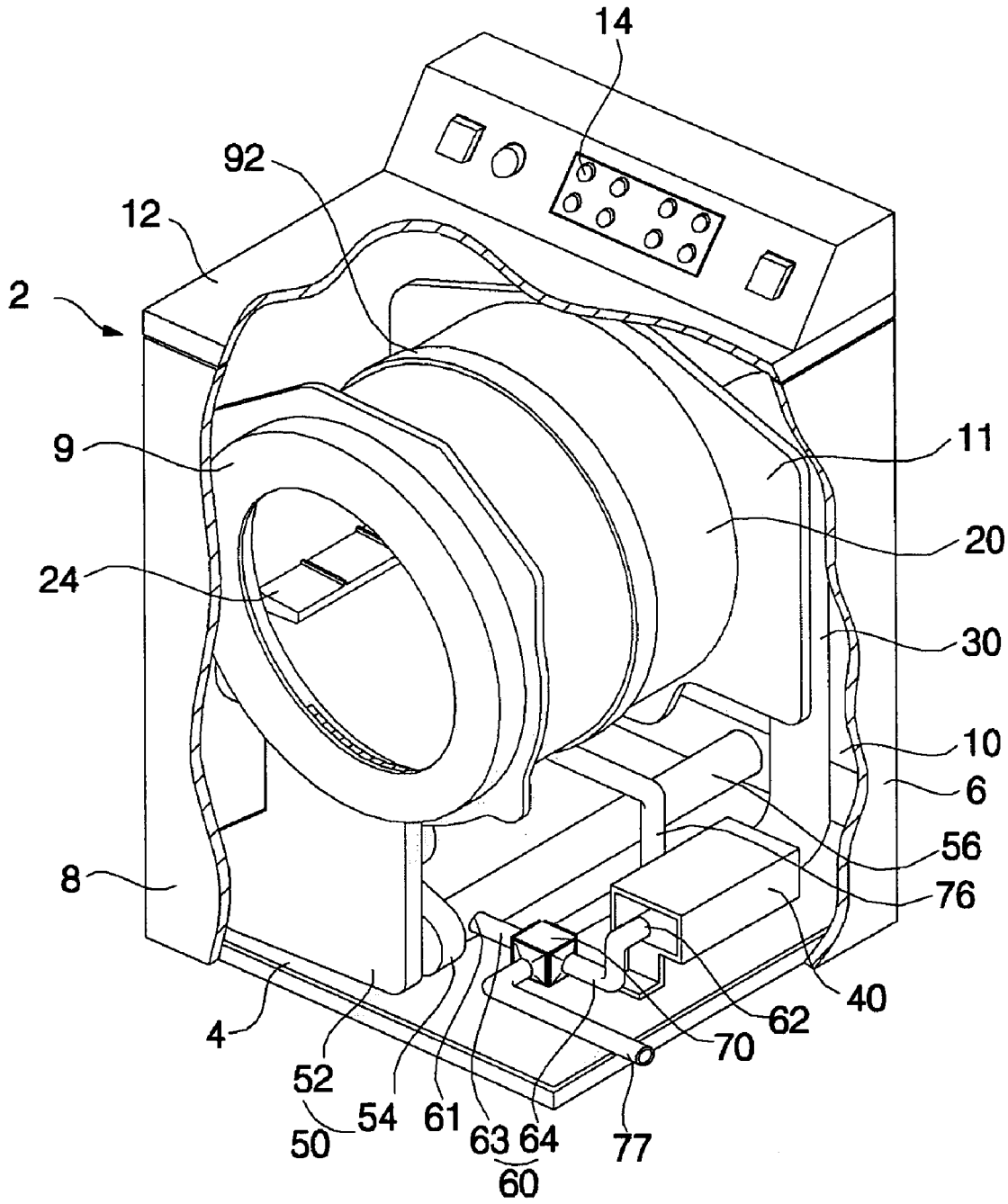
FIG. 3 is a perspective view, cutaway in part, of the drying machine shown in FIG. 1.

FIG. 2 is an exploded perspective view of the drying machine shown in FIG. 1, and FIG. 3 is a perspective view, cutaway in part, of the drying machine shown in FIG. 1.

As shown in FIGS. 2 and 3, the cabinet 2 comprises: a base pan 4; a cabinet body 6 fixedly disposed on the base pan 4; a cabinet cover 8 attached to the front part of the cabinet body 6; a back panel 10 attached to the rear part of the cabinet body 6; a top cover attached to the top part of the cabinet body 6; and a control panel 14 disposed on the top cover 12.

At the cabinet cover 8 is formed a laundry inlet/outlet hole 8*a* for allowing the laundry to be put into or taken out of the drum 20 therethrough, and to the cabinet cover 8 is hingedly connected a door 8*b* for opening and closing the laundry inlet/outlet hole 8*a*, as shown in FIG. 2.

To the rear of the cabinet cover 8 is attached a front supporter 9 for rotatably supporting the front end of the drum 20.

In front of the back panel 10 is disposed a rear supporter 11 for rotatably supporting the rear end of the drum 20.

At the rear supporter 11 is formed a communication hole 11*a* for allowing the inlet channel 30 to communicate with the entrance part of the drum 20 such that air having passed through the inlet channel 30 flows to the entrance part of the drum 20.

As shown in FIGS. 2 and 3, the drum 20 is formed in the shape of a cylinder whose front and rear ends are opened such that the laundry is put into the drum 20 and air flows through the drum from the rear end of the cabinet 2 to the front end of the cabinet 2. The open rear end of the drum 20 forms the entrance part of the drum 20, and the open front end of the drum 20 forms the exit part of the drum 20.

The drum 20 is provided at the inner circumference surface thereof with lifts 24, which are protruded inwardly from the inner circumference surface of the drum 20 for lifting the,laundry. When the drum 20 is rotated, the laundry is lifted by the lifts 24, and is then dropped from the lifts 24.

The inlet channel 30 comprises: an inlet duct having one end communicating with the heater 40 and the other end communicating with the communication hole 11*a* of the rear supporter 11.

As shown in FIGS. 2 and 3, the heater 40 comprises: a heater case disposed in front of the inlet channel 30, the heater case having one end communicating with the space between the cabinet 2 and the drum 20 and the other end communicating with the inlet channel 30; and a heating coil disposed in the heater case. When electric current is supplied to the heating coil, the heater case and the space in the heater case are heated, and thus, air passing through the heater case is heated. As a result, the air is changed into high-temperature and low-humidity air.

As shown in FIGS. 2 and 3, the outlet channel comprises: a lint duct 52 communicating with the exit part of the drum 20 for allowing air to flow out of the drum 20 therethrough, the lint duct 52 having a filter 51 disposed therein for filtering foreign matter, such as lint, from the air flowing out of the drum 20; a fan housing 54 communicating with the lint duct 52, the fan housing 54 having a blowing fan 80 mounted therein; and an outlet duct 56 having one end communicating with the fan housing 54 and the other end disposed at the outside of the cabinet 2.

To the outlet duct 56 is connected an external duct (not shown) for guiding the air having flowed out of the cabinet 2 to the outside of the house where the drying machine is installed.

As shown in FIGS. 2 and 3, the circulating channel 60 consists of a circulating duct having one end 61 communicating with a predetermined region of the circumferential part of the outlet duct 56 adjacent to the front end of the outlet duct 56 and the other end 62 disposed in the front of the heater 40.

The circulating duct comprises: a first circulating duct 63 disposed between the outlet duct 56 and the condenser 70 for guiding the air having passed through the outlet duct 56 to the condenser 70; and a second circulating duct 64 for guiding the air having passed through the condenser 70 to the heater 40.

As shown in FIG. 2, the condenser 70 comprises: first channel parts 71 for allowing the air introduced into the circulating channel 60 to flow therethrough; and second channel parts 72 for allowing external air, which takes heat away from the air passing through the first channel parts 71, to flow therethrough.

The first channel parts 71 of the condenser 70 extend from one side to the other side of the condenser 70, and the second channel parts 72 of the condenser 70 extend from the front end to the rear end of the condenser 70. The first and second channel parts 71 are disposed such that the first and second channel parts 71 are alternately vertically stacked with partitions disposed between the respective first and second channel parts 71.

When external air passes through the second channel parts 72 of the condenser 70 while circulating air passes through the first channel parts 71 of the condenser 70, heat exchange occurs between the circulating air and the partitions. As a result, the circulating air is condensed, and therefore, the humidity of the air is decreased.

The drying machine according to the present invention further comprises: an external air inlet duct 73 for introducing external air from the outside of the cabinet 2; an external air fan housing 74 and an external air blowing fan 75 for allowing the external air having passed through the external air inlet duct 73 to flow therethrough; an external air guide duct 76 for guiding the external air having passed through the external air fan housing 74 to the second channel parts 72 of the condenser 70; and an external air outlet duct 77 for guiding the air having passed through the second channel parts 72 of the condenser 70 to the outside of the cabinet 2.

Also, the drying machine according to the present invention further comprises: a belt 92 wound on the outer circumferential surface of the drum 20; and a motor 94 mounted to the base pan 4 for rotating the external air blowing fan 75, the blowing fan 80, and the belt 92.

Reference numeral 10*a* indicates air inlet holes formed at the back cover 10 for allowing air to be introduced into the inside of the cabinet 2 therethrough.

Reference numeral 10*b* indicates a duct insertion hole formed at the back cover 10, through which the outlet duct 56 is inserted.

The operation of the drying machine with the above-stated construction according to the present invention will now be described.

When a user puts the laundry into the drum 20, closes the door 8*b*, and then manipulates the control panel 14, the heater 40 is turned on, and the motor 94 is driven.

As the heater 40 is operated, the interior of the heater case is heated. As the motor 94 is operated, the belt 92, the external air blowing fan 75, and the blowing fan 80 are rotated.

As the belt 92 is rotated, the drum 20 is also rotated. As a result, the laundry in the drum 20 is repeatedly lifted by the lifts 24 and then dropped from the lifts 24.

As the external air blowing fan 75 is rotated, external air from the outside of the cabinet 2 is introduced into the inlet duct 73, passes through the external air fan housing 74 and the external air guide duct 76, and then flows to the second channel parts 72 of the condenser 70. After passing through the second channel parts 72 of the condenser 70, the air is discharged out of the drying machine through the external air outlet duct 77.

As the blowing fan 80 is rotated, on the other hand, external air from the outside of the cabinet 2 is introduced into the cabinet 2 through the air inlet holes 10*a* due to a blowing force generated when the blowing fan 80 is rotated. The air introduced into the cabinet 2 passes through the heater 40. As a result, the air is changed into high-temperature and low-humidity air. The heated air is guided to the inlet duct 30.

The high-temperature and low-humidity air guided to the inlet duct 30 is introduced into the drum 20 through a communication hole 11*a* of the rear supporter 11, and then flows to the front part of the drum. As a result, the air comes into contact with the laundry, and therefore, the temperature of the air is decreased, and the humidity of the air is increased.

The low-temperature and high-humidity air passes through the lint duct 52. At this time, foreign matter, such as lint, is filtered from the low-temperature and high-humidity air by the filter 51 disposed in the lint duct 52. Thereafter, the air passes through the fan housing 54, and is then blown to the outlet duct 56.

Some of the low-temperature and high-humidity air blown to the outlet duct 56 is discharged to the rear of the outlet duct 56, and the rest of the low-temperature and high-humidity air blown to the outlet duct 56 is introduced into the first channel parts 71 of the condenser 70 through the first circulating duct 63.

While the low-temperature and high-humidity air passes through the first channel parts 71 of the condenser 70, heat exchange occurs between the low-temperature and high-humidity air passing through the first channel parts 71 of the condenser 70 and the external air passing through the second channel parts 72 of the condenser 70. As a result, the low-temperature and high-humidity air passing through the first channel parts 71 of the condenser 70 is condensed, and therefore, the humidity of the air is decreased. This low-humidity air is introduced again into the heater 40 while being mixed with new air being introduced into the heater 40. Subsequently, the mixed air is introduced into the drum 20 through the inlet duct 30 and the communication hole 11*a* of the rear supporter 11.

If the exhaust resistance of air at the rear of the outlet duct 56 is increased during operation of the drying machine, the flow rate of air discharged to the rear of the outlet duct 56 is decreased. However, the flow rate of air flowing from the outlet duct 56 to the heater 40 through the first circulating duct 63, the condenser 70, and the external air circulating duct 64 is increased. Consequently, air condensed by the condenser 70 and new air is sufficiently introduced into the heater 40, whereby effective operating efficiency of the heater 40 is not decreased.

Figure 4:
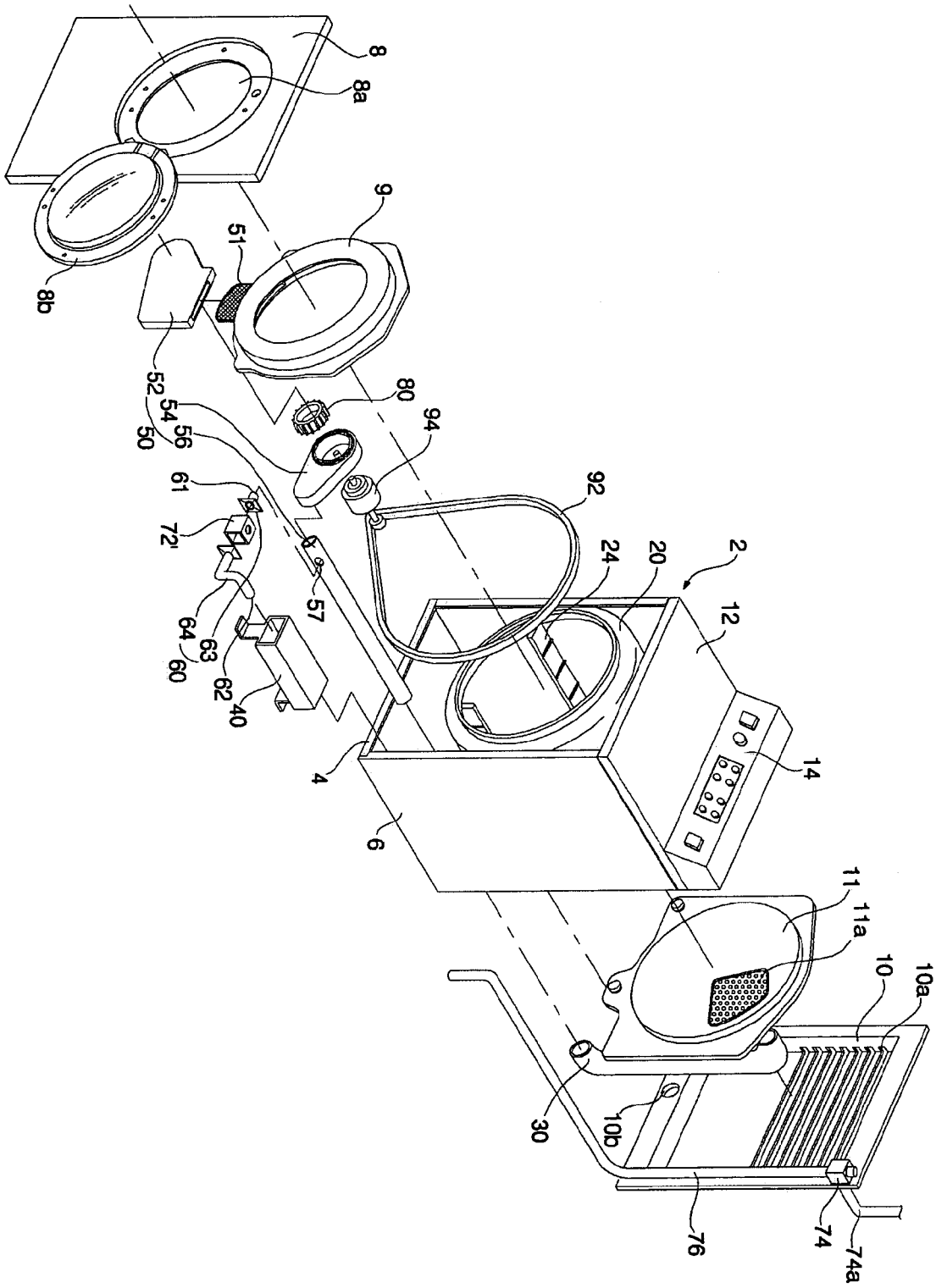
FIG. 4 is an exploded perspective view of a drying machine according to another preferred embodiment of the present invention.
Figure 5:
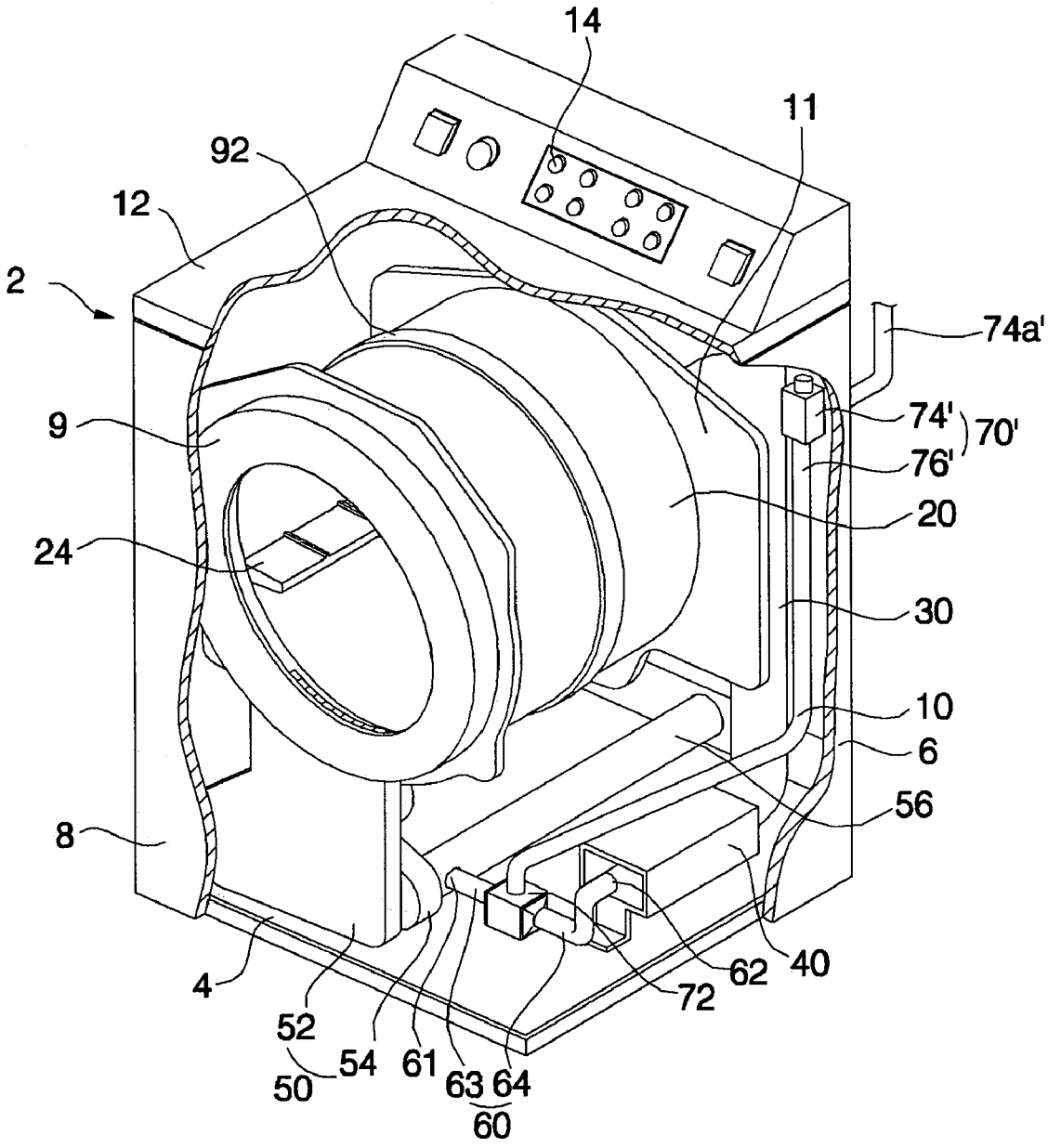
FIG. 5 is a perspective view, cutaway in part, of the drying machine shown in FIG. 4.

FIG. 4 is an exploded perspective view of a drying machine according to another preferred embodiment of the present invention, and FIG. 5 is a perspective view, cutaway in part, of the drying machine shown in FIG. 4.

The drying machine according to this embodiment of the present invention shown in FIGS. 4 and 5 is identical in construction and operation to the drying machine according to the previous embodiment of the present invention shown in FIGS. 1 to 3 except that the condenser is operated in a water-cooling fashion instead of an air-cooling fashion. Therefore, other components of the drying machine according to this embodiment of the present invention shown in FIGS. 4 and 5, which correspond to those of the drying machine according to the previous embodiment of the present invention shown in FIGS. 1 to 3, are indicated by the same reference numerals as those of the drying machine according to the previous embodiment of the present invention shown in FIGS. 1 to 3, and a detailed description thereof will not be given.

The condenser comprises: a condensing duct 72' for allowing air introduced into the circulating channel 60 to flow therethrough; and a cooling water supplying unit for supplying cooling water to the condensing duct 72' to condense air passing through the condensing duct 72'.

The condensing duct 72' is disposed between the first circulating duct 63 and the second circulating duct 64. The condensing duct 72' has one end communicating with the first circulating duct 63 and the other end communicating with the second circulating duct 64.

The cooling water supplying unit comprises: a cooling water valve 74' connected to an external hose 74*a*' for allowing cooling water supplied from the external hose 74*a*' to flow therethrough or stopping the cooling water from flowing therethrough; and a cooling water hose 76' for guiding cooling water having passed through the cooling water valve 74' into the condensing duct 72'.

In the drying machine according to this embodiment of the present invention, the heater 40 is turned on, the motor 94 is driven, and the cooling water valve 74' is turned on.

When the cooling water valve 74' is turned on, cooling water supplied from the external hose 74*a*' passes through the cooling water valve 74' and the cooling water hose 76', and then drops onto the inner bottom part of the condensing duct 72 or flows down along the inner wall of the condensing duct 72'.

On the other hand, low-temperature and high-humidity air, introduced into the condensing duct 72' from the outlet duct 56 through the first circulating duct 63, is condensed while being cooled by the cooling water. As a result, the humidity of the air is decreased. The low-humidity air passes through the second circulating duct 64, and is then reintroduced into the heater 40 while being mixed with new air introduced into the heater 40.

The cooling water supplied into the condensing duct 72' is discharged out of the drying machine through the first circulating duct 63 and the outlet duct 56.

Figure 6:
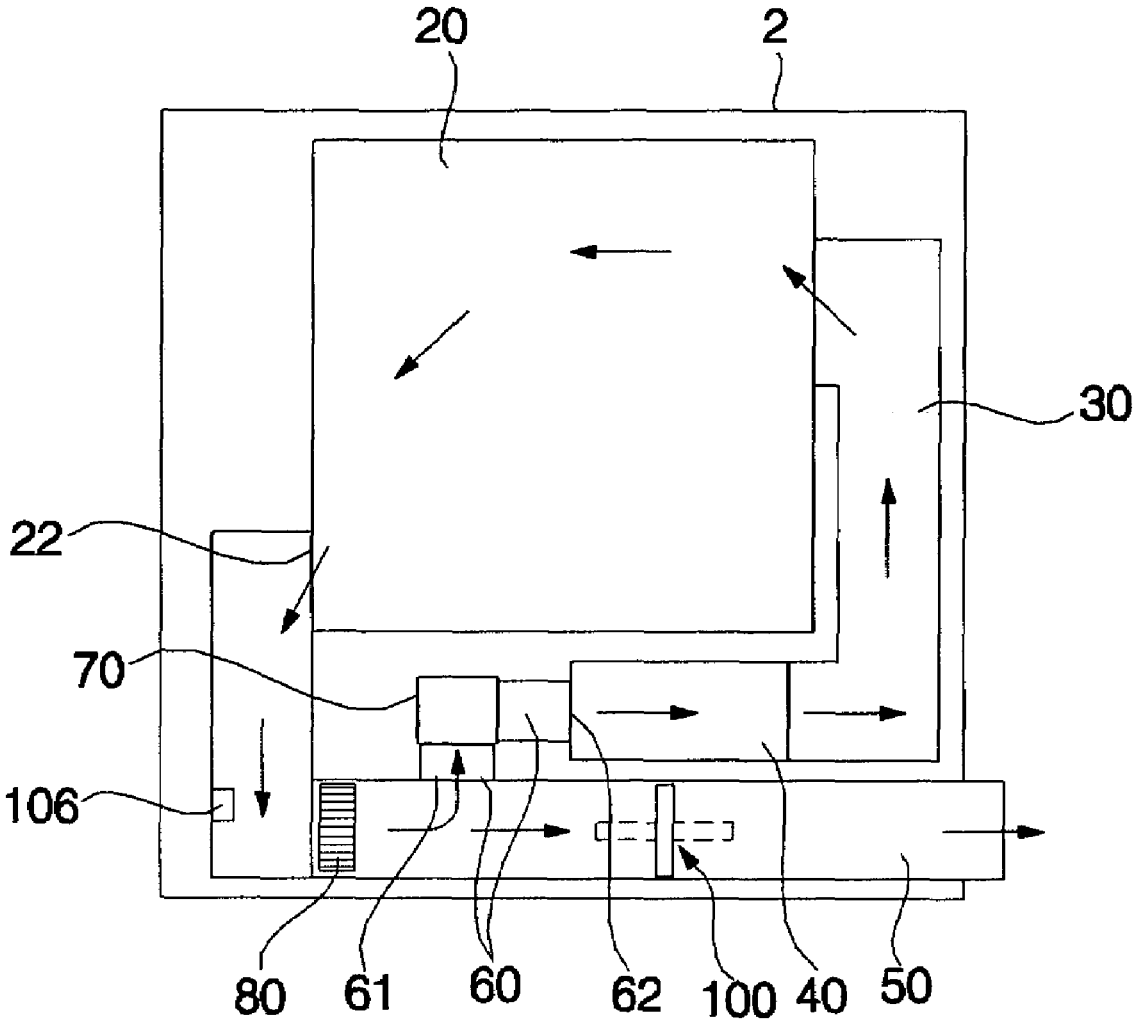
FIG. 6 is a schematic view illustrating air flow in a drying machine according to yet another preferred embodiment of the present invention.
Figure 7:
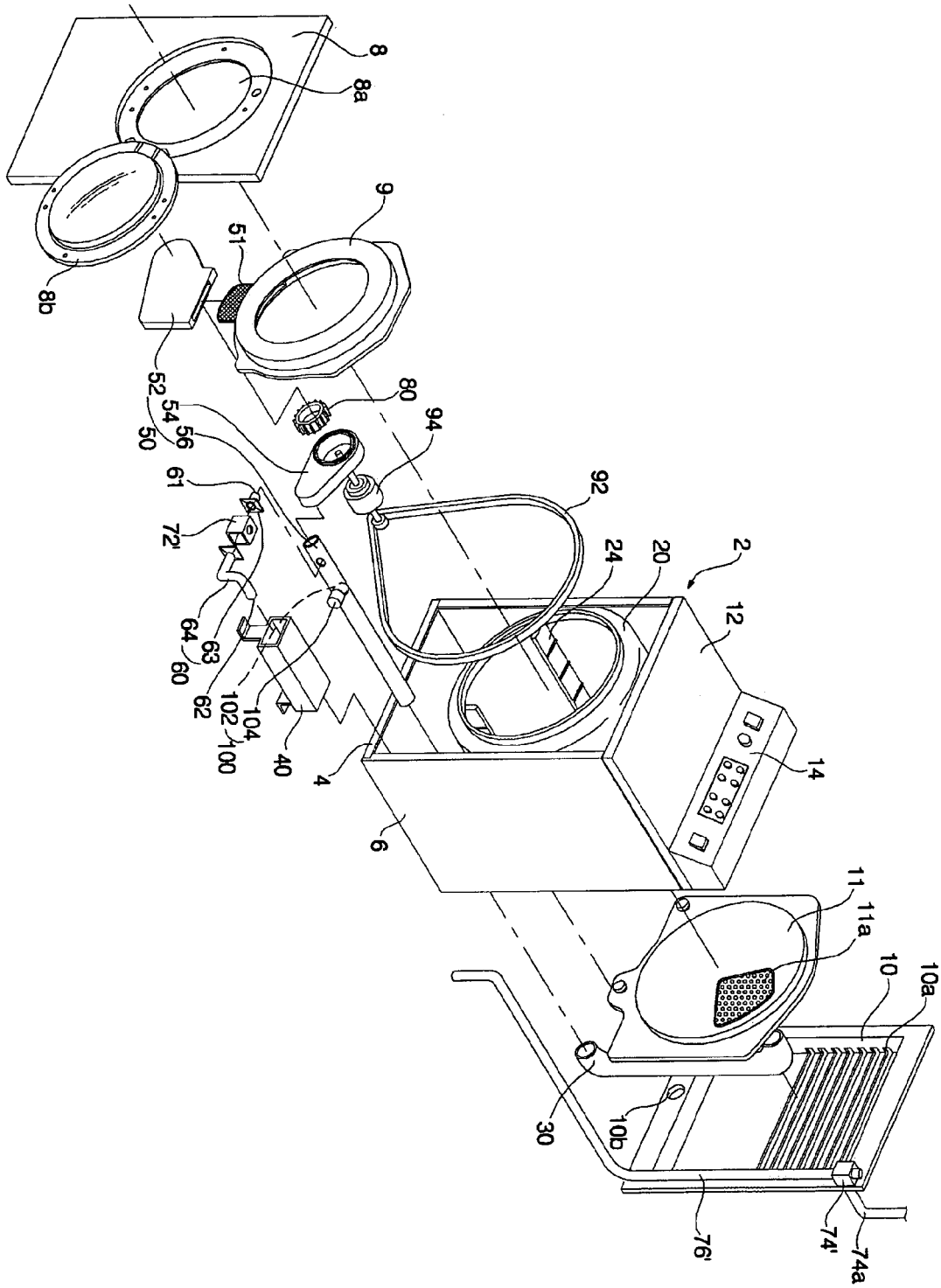
FIG. 7 is an exploded perspective view of the drying machine shown in FIG. 6.
Figure 8:
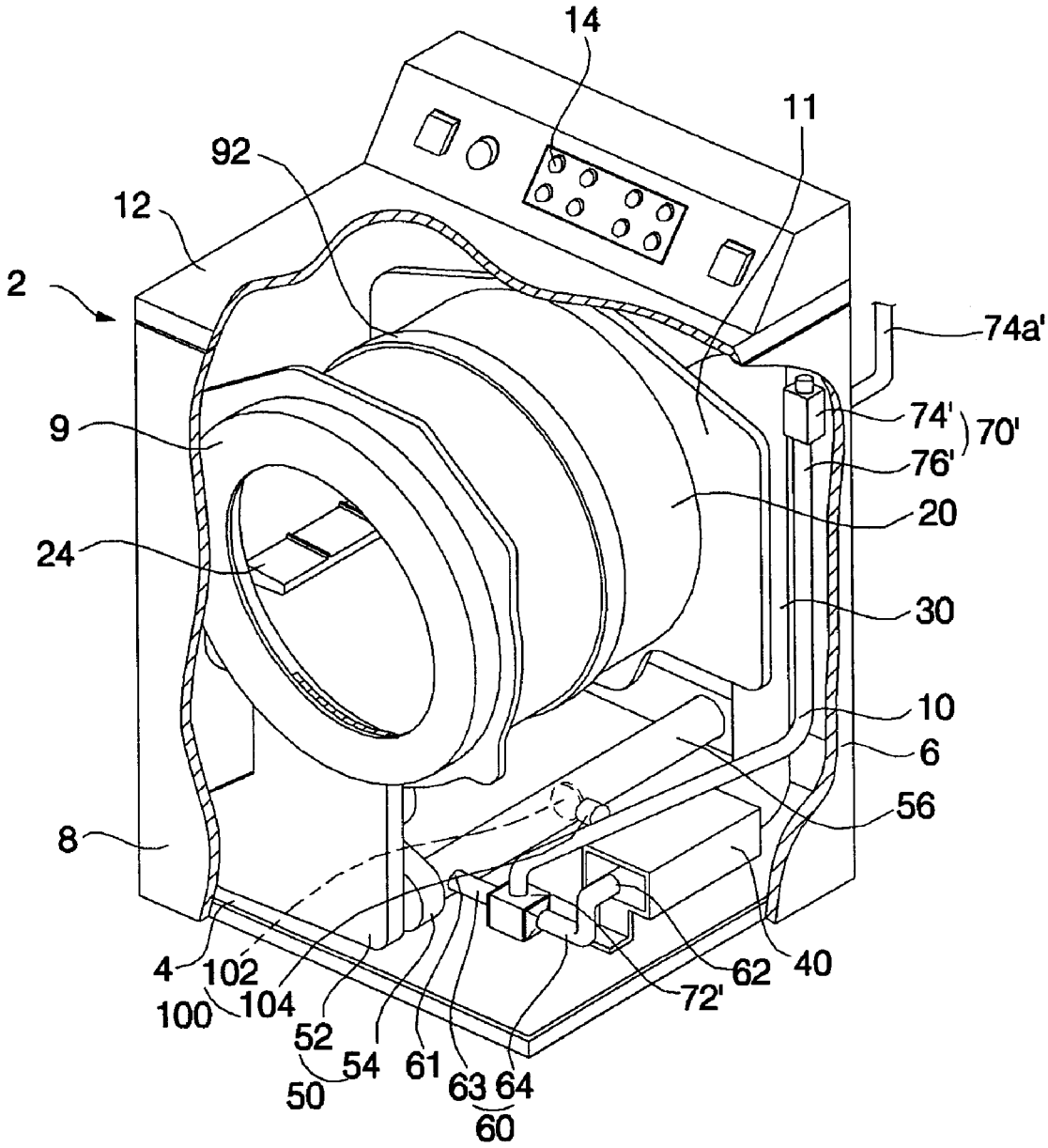
FIG. 8 is a perspective view, cutaway in part, of the drying machine shown in FIG. 6.

FIG. 6 is a schematic view illustrating air flow in a drying machine according to yet another preferred embodiment of the present invention, FIG. 7 is an exploded perspective view of the drying machine shown in FIG. 6, and FIG. 8 is a perspective view, cutaway in part, of the drying machine shown in FIG. 6.

The drying machine according to this embodiment of the present invention shown in FIGS. 6 to 8 is identical in construction and operation to the drying machine according to any one of the previous embodiments of the present invention shown in FIGS. 1 to 5 except that the drying machine further comprises: an air flow rate control unit 100 disposed in the outlet channel 50 for controlling the flow rate of air passing through the outlet channel 50 or the circulating channel 60. Therefore, other components of the drying machine according to this embodiment of the present invention shown in FIGS. 6 to 8, which correspond to those of the drying machine according to any one of the previous embodiments of the present invention shown in FIGS. 1 to 5, are indicated by the same reference numerals as those of the drying machine according to any one of the previous embodiments of the present invention shown in FIGS. 1 to 5, and a detailed description thereof will not be given.

The air flow rate control unit 100 consists of an air flow rate control valve disposed in the outlet channel 50 between the rear end of the outlet channel 50 and the end 61 of the circulating channel 60 for controlling the flow rate of air discharged through the outlet channel 50.

The air flow rate control valve 100 comprises: a plate body 102 rotatably disposed in the outlet duct 56 for opening or closing the outlet channel 50, especially, the inner passage of the outlet duct 56; and a solenoid 104 having a shaft for rotating the plate body 102.

The air having passed through the outlet duct 56 is guided in two different fashions by the air flow rate control valve 100. In one fashion, the air having passed through the outlet duct 56 is guided to the condenser 70 by the air flow rate control valve 100. In the other fashion, some of the air having passed through the outlet duct 56 is guided to the rear of the outlet duct 56, and the rest of the air having passed through the outlet duct 56 is guided to the condenser 70 by the air flow rate control valve 100.

In addition, the air flow rate control valve 100 may be operated based on the change in temperature of the air discharged through the outlet duct 56. Alternatively, the air flow rate control valve 100 may be operated for a predetermined period of time after the drying machine is initially operated.

Reference numeral 106 indicates a temperature sensor for measuring temperature of air discharged from the drum 20.

When a user manipulates the control panel 14 of the drying machine, the heater 40 is turned on, the motor 94 is driven, and the air flow rate control valve 100 is controlled to be operated in dual mode.

In the dual mode, the plate body 102 is rotated by the solenoid 104 such that the plate body 102 is horizontally disposed to maximally open the inner passage of the outlet duct 56.

Since the inner passage of the outlet duct 56 is maximally opened, some of the air, having flowed out of the drum 20 and then flowing through the outlet channel 50, is condensed by the condenser 70 and heated by the heater 40, and is then introduced into the drum 20; the rest of the air is discharged out of the drying machine or the drying machine with washing function.

As the operation of the drying machine is performed as described above, the amount of moisture absorbed from the laundry is gradually decreased, and the temperature of the air flowing out of the drum 20 is relatively increased while the humidity of the air flowing out of the drum 20 is relatively decreased, as compared to the air having flowed out of the drum 20 at the first stage-of the drying operation.

When a predetermined period of time elapses after the air flow rate control valve 100 is controlled to be operated in the dual mode (i.e., at the last stage of the drying operation), or when the temperature of the air flowing out of the drum 20 is above a predetermined level, the air flow rate control valve 100 is controlled to be operated in circulation mode.

In the circulation mode, the plate body 102 is rotated by the solenoid 104 such that the plate body 102 is vertically disposed to close the inner passage of the outlet duct 56.

Since the inner passage of the outlet duct 56 is completely closed, all of the air, having flowed out of the drum 20 and then flowing through the outlet channel 50, is condensed by the condenser 70 and heated by the heater 40, and is then introduced into the drum 20.

Figure 9:
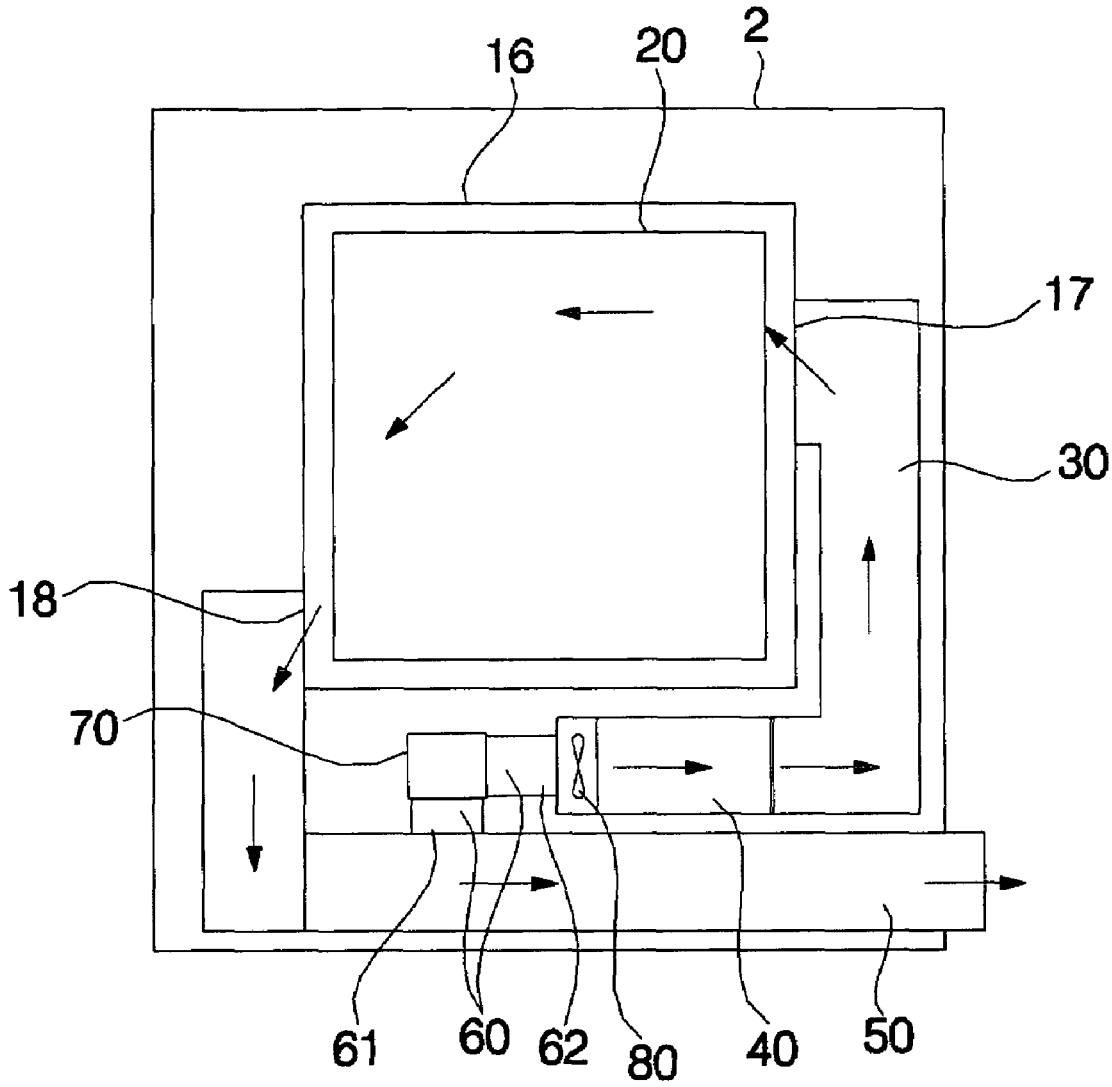
FIG. 9 is a schematic view illustrating air flow in a drying machine with washing function according to a preferred embodiment of the present invention.

FIG. 9 is a schematic view illustrating air flow in a drying machine with washing function according to a preferred embodiment of the present invention.

As shown in FIG. 9, the drying machine with washing function comprises: a tub 16 mounted in a cabinet 2 for receiving wash water necessary to wash or rinse the laundry; a drum 20 rotatably disposed inside the tub 16 for receiving the laundry, the drum 20 being provided with through-holes (not shown) for allowing wash water or air to flow into or flow out of the tub 16 therethrough; an inlet channel 30 for introducing air into the drum 20; a heater 40 for heating air introduced into the inlet channel 30; an outlet channel 50 for discharging air, used to dry the laundry in the drum 20, out of the cabinet 2; and a circulating channel 60 connected between the outlet channel 50 and the heater 40.

The tub 16 is provided at one end thereof with a tub entrance part 17 for allowing air having passed through the inlet channel 30 to be introduced into the drum 20 therethrough, and the other end thereof with a tub exit part 18 for allowing air, having dried the laundry in the drum 20 and flowed to the space between the drum and the tub 16 through the through-holes of the drum 20, to flow to the outlet channel 50 therethrough.

To the tub 16 is connected a water supply unit for supplying water having a detergent contained therein or clean water, i.e., water having no detergent contained therein (hereinafter, referred to as "wash water") into the tub 16 during the washing operation or the rinsing operation of the drying machine with washing function. To the tub 16 is also connected a drainage unit for draining contaminated water in the tub 16 or water separated from the laundry and then gathered in the tub 16 out of the cabinet 2.

To the tub 16 is attached a motor (not shown) for rotating the drum 20 while supporting the drum 20.

The drying machine with washing function further comprises: a condenser 70 for condensing air passing through the circulating channel 60.

In front of the heater 40 is disposed a blowing fan 80. It is also possible, however, for the blowing fan 80 to be disposed in the inlet channel 30, or disposed in the outlet channel 50 between the end 61 of the circulating channel 60 and the tub exit part 18 of the tub 16.

The drying machine with washing function further comprises: a fan motor for rotating the blowing fan 80, which is connected to the fan motor.

Other components, such as the inlet channel 30, heater 40, the outlet channel 50, the circulating channel 60, and the condenser 70, of the drying machine with washing function according to this embodiment of the present invention shown in FIG. 9 are identical to those of the drying machine according to at least one of the previous embodiments of the present invention shown in FIGS. 1 to 8. Accordingly, a detailed description thereof will not be given.

During the washing or rinsing operation of the drying machine with washing function, wash water supplied from the water supply unit is introduced into the tub 16, and at the same time, the drum 20 is rotated by the motor, such that the laundry in the drum 20 is washed or rinsed. After the washing or rinsing operation of the drying machine with washing function has been finished, contaminated water in the tub 16 is drained out of the drying machine with washing function by the drainage unit.

During the dewatering operation of the drying machine with washing function, the drum 20 is rotated at high speed by the motor such that water is centrifugally separated from the laundry in the drum 20, and the water, separated from the laundry and gathered in the tub 16, is drained out of the drying machine with washing function by the drainage unit.

During the drying operation of the drying machine with washing function, the drum 20 is rotated by the motor such that the laundry is agitated in the drum 20. At this time, the blowing fan 80 is rotated, and the heater 40 is turned on.

Other operations, such as rotating the blowing fan 80, turning the heater 40 on, and drying the laundry in the exhausting/condensing fashion, of the drying machine with washing function shown in FIG. 9 are identical to those of the drying machine according to at least one of the previous embodiments of the present invention shown in FIGS. 1 to 8. Accordingly, a detailed description thereof will not be given.

As apparent from the above description, the drying machine or the drying machine with washing function according to the present invention has the following effects.

The drying machine or the drying machine with washing function according to the present invention comprises: a heater for heating air introduced into an inlet channel of a drum; an outlet channel for allowing air in the drum to be discharged out of the drying machine or the drying machine with washing function therethrough; and a circulating channel connected between the outlet channel of the drum and the heater. When the exhaust resistance of air at the outlet channel is large, some of the air, passing through the outlet channel, is guided to the heater through the circulating channel. Consequently, the drying machine or the drying machine with washing function according to the present invention has an effect in that air flow rate sufficient to dry the laundry is obtained and time necessary to dry the laundry is reduced.

The drying machine or the drying machine with washing function according to the present invention further comprises: a condenser for condensing air passing through the circulating channel. Consequently, the drying machine or the drying machine with washing function according to the present invention has an effect in that the laundry can be dried either in an exhausting fashion or in a condensing fashion.

Also, the method of controlling the drying machine or the drying machine with washing function according to the present invention has the following effect.

At the last stage of the drying operation or when the temperature of the air flowing out of the drum is above a predetermined level, all of the air having flowed out of the drum passes through the condenser and the heater, and is then reintroduced into the drum such that the laundry can be dried. At this time, the temperature of the air is relatively high while the humidity of the air is relatively low, as compared to the air introduced into the drum at the first stage of the drying operation. Consequently, the method of controlling the drying machine or the drying machine with washing function according to the present invention has an effect in that power consumption of the heater is reduced and total time necessary to dry the laundry is reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A drying machine comprising:

a drum disposed in a cabinet to receive laundry;

an inlet channel configured to allow external air to be introduced into the drum therethrough;

a heater configured to heat air introduced into the inlet channel;

an outlet channel configured to allow air in the drum to be discharged out of the cabinet therethrough;

a circulating channel connected between the outlet channel and the heater such that at least a portion of air flowing through the outlet channel is introduced into the heater through the circulating channel before being discharged out of the cabinet and circulated into the drum; and a condenser configured to condense the circulated air such that a humidity of air passing through the circulating channel is decreased, said condenser comprising first channel parts that allow the air introduced into the circulating channel to flow therethrough, and second channel parts that allow external air, necessary to take heat away from the air passing through the first channel parts, to flow therethrough.

2. The machine as set forth in claim 1, wherein the condenser further comprises:

an external air inlet duct that introduces external air from the outside of the cabinet;

an external air fan housing and an external air blowing fan that allows the external air having passed through the external air inlet duct to flow therethrough;

an external air guide duct that guides the external air having passed through the external air fan housing to the second channel parts; and an external air outlet duct that guides the air having passed through the second channel parts to the outside of the cabinet.

3. A drying machine comprising:

a drum disposed in a cabinet to receive laundry;

an inlet channel configured to allow external air to be introduced into the drum therethrough;

a heater configured to heat air introduced into the inlet channel;

an outlet channel configured to allow air in the drum to be discharged out of the cabinet therethrough;

a circulating channel connected between the outlet channel and the heater such that at least a portion of air flowing through the outlet channel is introduced into the heater through the circulating channel before being discharged out of the cabinet and circulated into the drum; and a condenser configured to condense the circulated air such that a humidity of air passing through the circulating channel is decreased, said condenser comprising a condensing duct that allows air introduced into the circulating channel to flow therethrough, and a cooling water supplying unit that supplies cooling water to the condensing duct to condense air passing through the condensing duct.

4. The machine as set forth in claim 3, wherein the cooling water supplying unit comprises:

a cooling water valve connected to an external hose that allows cooling water supplied from the external hose to flow therethrough or stopping the cooling water from flowing therethrough; and a cooling water hose that guides cooling water having passed through the cooling water valve into the condensing duct.

5. The machine as set forth in claim 1, wherein the circulating channel consists of a circulating duct having one end communicating with one side of the outlet channel and the other end disposed in the front of the heater.

6. The machine as set forth in claim 5, wherein the circulating duct comprises:

a first circulating duct disposed between the side of the outlet channel and the condenser that guides the air having passed through the outlet channel to the condenser; and a second circulating duct that guides the air having passed through the condenser to the heater.

7. The machine as set forth in claim 1, further comprising:

a blowing fan disposed in the outlet channel between a drum-side outlet part that allows air in the drum to flow to the outlet channel therethrough and one end of the circulating channel communicating with the outlet channel, whereby air is distributed to the outlet channel and the circulating channel based on the exhaust resistance of air at the rear of the outlet channel.

8. The machine as set forth in claim 1, further comprising:

an air flow rate control unit disposed in the outlet channel that controls the flow rate of air passing through the outlet channel or the circulating channel.

9. The machine as set forth in claim 8, wherein the air flow rate control unit comprises:

an airflow rate control valve disposed in the outlet channel between a rear end of the outlet channel and one end of the circulating channel communicating with the outlet channel that controls the flow rate of air discharged through the outlet channel.

10. The machine as set forth in claim 9, wherein the air flow rate control valve comprises:

a plate body rotatably disposed in the outlet channel that opens or closes the outlet channel; and a solenoid having a shaft for rotating the plate body.

11. The machine as set forth in claim 8, further comprising:

a temperature sensor that measures temperature of air discharged from the drum.

* * * * *